US006715430B2

(12) United States Patent
Choi et al.

(10) Patent No.: US 6,715,430 B2
(45) Date of Patent: Apr. 6, 2004

(54) SECTIONAL TABLE WITH GUSSET

(76) Inventors: Jae Chul Choi, 101-707 Chumdanmoa Apt. Woigye-dong, Kwangsan-ku, Kwangju (KR); Choon Yong Choi, 601-1103 Makslong Apt. 211 Mok 5-dong, Yangchun-ku, Seoul (KR)

( * ) Notice: Subject to any disclaimer, the term of this patent is extended or adjusted under 35 U.S.C. 154(b) by 0 days.

(21) Appl. No.: 10/199,796

(22) Filed: Jul. 19, 2002

(65) Prior Publication Data

US 2004/0011260 A1 Jan. 22, 2004

(51) Int. Cl.[7] ..... A47B 13/00
(52) U.S. Cl. ..... 108/153.1; 24/188.1
(58) Field of Search ..... 108/156, 153.1, 108/157.1, 158.11, 159; 248/188, 188.1, 188.8

(56) References Cited

U.S. PATENT DOCUMENTS 527,145 A * 10/1894 Dempsey ..... 248/188
3,267,888 A * 8/1966 Carlson ..... 108/158
3,406,935 A * 10/1968 Mutchnik et al. ..... 248/188
3,530,804 A * 9/1970 Broome ..... 108/156
4,011,821 A * 3/1977 Neal ..... 108/156
4,925,140 A * 5/1990 Camarota ..... 248/188
5,026,010 A * 6/1991 Camarota ..... 248/188.1
5,165,349 A * 11/1992 McAllister ..... 108/156

FOREIGN PATENT DOCUMENTS

DE 29621414 * 3/1997

* cited by examiner

*Primary Examiner*—Jose V. Chen
(74) *Attorney, Agent, or Firm*—Lee, Hong, Degerman, Kang & Schmadeka

(57) ABSTRACT

Disclosed is a sectional table with gussets, in which a table top and legs thereof can be easily assembled in a simple manner by virtue of a gusset mechanism. The sectional table with gussets includes a table top; an inverted hat-shaped channel frame having cylindrical parts on the central portion thereof and flanges on both ends thereof, the cylindrical parts being formed through a deep-drawing process and the flanges being fixedly secured to the underside of the table top; cylindrical gussets inserted into the cylindrical parts of the channel frame at the upper end thereof to be fixedly secured to the cylindrical parts; and table legs secured to the underside of the table top by the gussets by being inserted into openings of the gussets.

6 Claims, 7 Drawing Sheets

SECTIONAL TABLE WITH GUSSET

BACKGROUND OF THE INVENTION

1. Field of the Invention

The present invention relates to a sectional table, and more particularly, to a sectional table with gussets in which a table top and legs thereof can be easily assembled in a simple manner through a gusset mechanism.

2. Background of the Related Art

In general, a table is a general term of furniture for dining, serving, meeting, working, etc. It allows various goods or foodstuffs to be put thereon and helps a separate work to be efficiently conducted. Such a table is largely classified into two types of tables depending on the structure thereof, one being a fixed table in which table legs thereof are directly fixed to the underside of a table top thereof, and the other being a sectional table in which table legs thereof can be separated from and assembled with a table top thereof.

Recently, to achieve mass production and improvement of efficiency in assembling a table, a sectional table in which the table top and the table legs are assembled together by using various types of connecting members is more widely used, relatively to others. A gusset is one of the connecting members.

As shown in FIG. 1, a conventional sectional table with gussets is constructed in such a manner that gussets 6 are directly welded to a channel frame 4 that is secured to the lower surface of a table top 2 of the sectional table. In consequence, the table is simply assembled but is unstable structurally, such that the connected structure may be damaged due to a small impact, thereby revealing a limitation in fixing.

To solve the aforementioned problem, a worktable having an improved coupled structure between the channel frame and the gussets has been disclosed in U.S. Pat. No. 5,165,349. The worktable, as illustrated in FIG. 2, includes a table top 2; an inverted hat-shaped channel frame 4 having openings 1 formed at the central portion thereof and flanges 3 formed at both ends thereof to be fixedly secured to the underside of the table top 2; a back-up plate 5 secured by welds between upwardly extending opposite side portions of the channel frame 4; gussets 6 at each leg location extending through the opening 1 in the channel frame 4 and upwardly inserted into the channel frame 4 to be fixedly secured to the channel frame 4 and the backup-plate 5 by welds; and table legs 7 secured to the underside of the table top 2 by the gussets by being inserted into the gussets 6.

The worktable constructed as above has a drawback of making the construction and structure complicated since the gussets 6 are fixedly secured to the back-up plate 5 which, in turn, is secured to the channel frame 4. Also the worktable has another drawback of deteriorating workability and efficiency in assembling since there are a great number of welded portions, such as those between the gussets and the back-up plate, the back-up plate and the channel frame, and the openings and the gussets.

Further, manufacturing costs, which accordingly increase, cannot be disregarded.

SUMMARY OF THE INVENTION

Accordingly, the present invention is directed to a sectional table with gussets that substantially obviates one or more problems due to limitations and disadvantages of the related art.

An object of the present invention is to provide a sectional table with gussets that can simplify work processes by improving the structure where gussets and a channel frame of the sectional table are assembled, and rigidly maintain the assembled state.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a sectional table with gussets, including a table top; an inverted hat-shaped channel frame having cylindrical parts formed at the central portion thereof and flanges formed at both ends thereof, the cylindrical parts being formed through a deep-drawing process and the flanges being fixedly secured to the underside of the table top; cylindrical gussets inserted into the cylindrical parts of the channel frame at the upper end thereof to be fixedly secured to the cylindrical parts by welds; and table legs secured to the underside of the table top by the gussets by being inserted into openings of the gussets.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
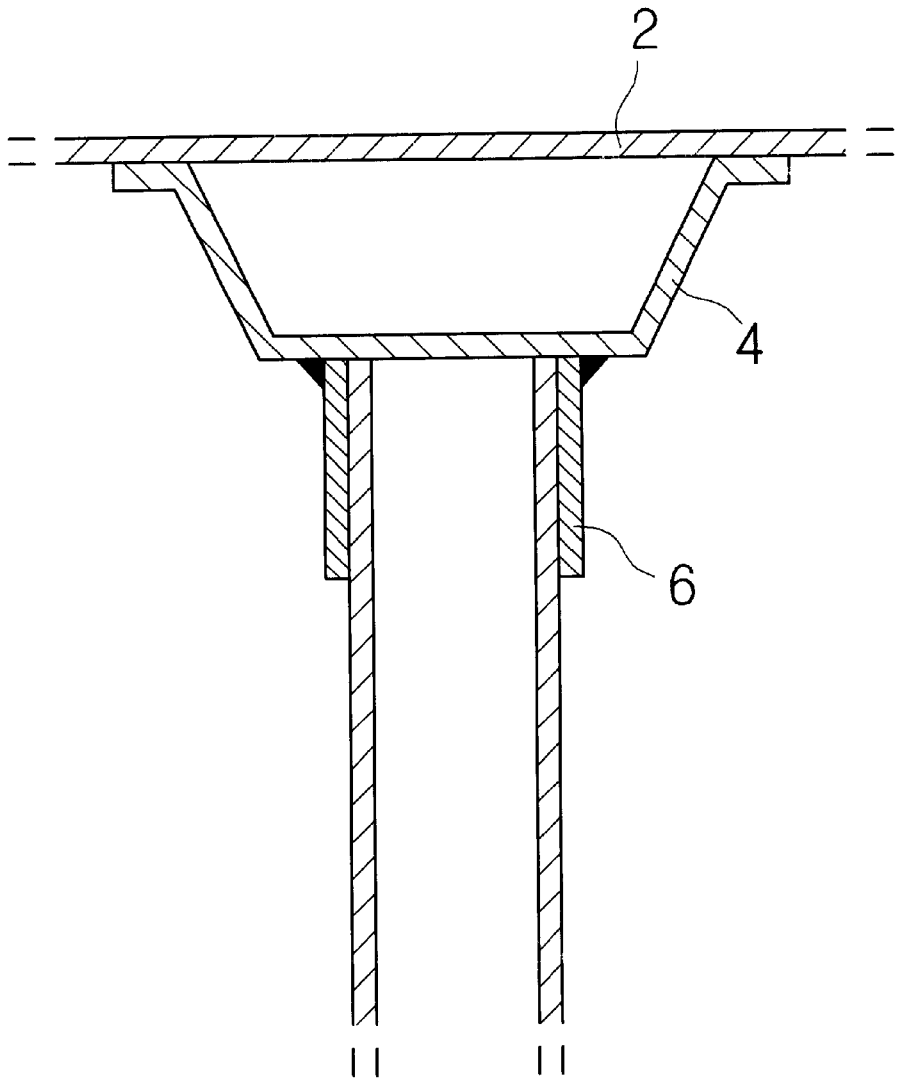
FIG 1 RELATED ART
FIG. 1 is a cross sectional view of a conventional sectional table with gussets.
Figure 2:
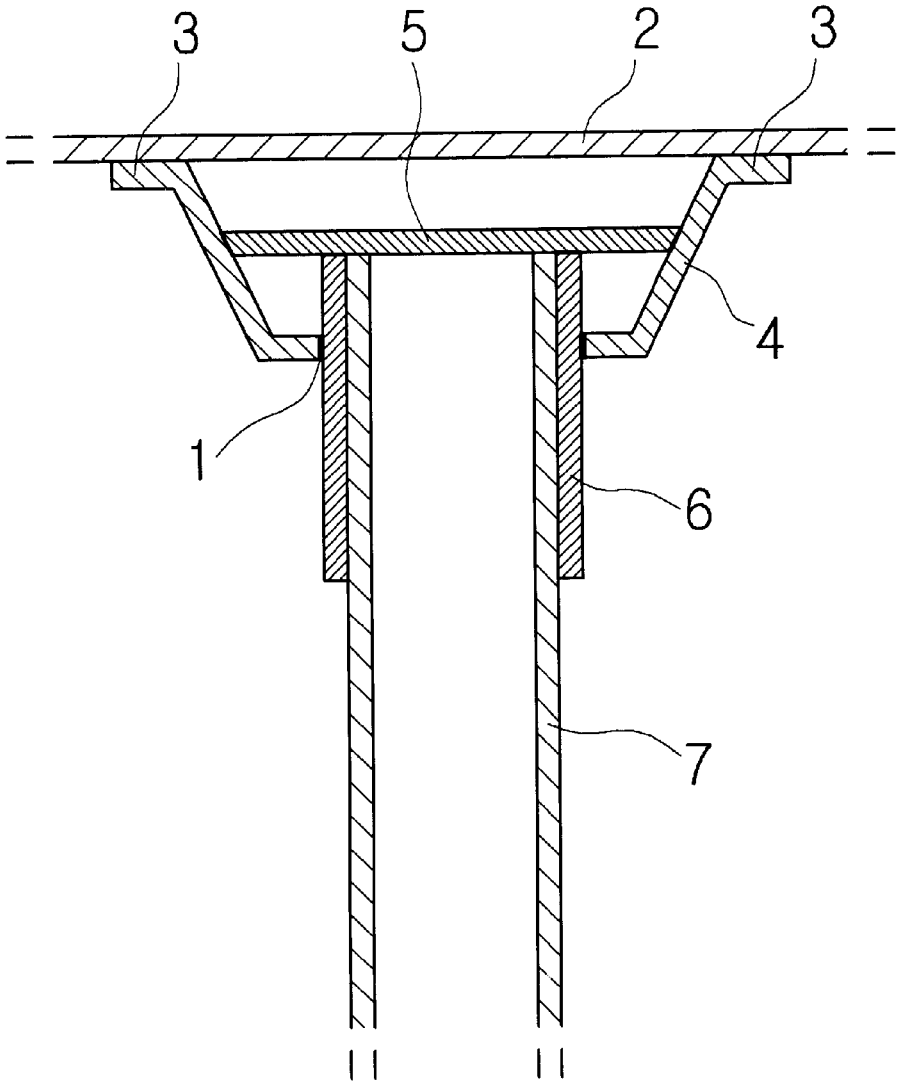
FIG 2 RELATED ART
FIG. 2 is a cross sectional view of another conventional sectional table with gussets.
Figure 3:
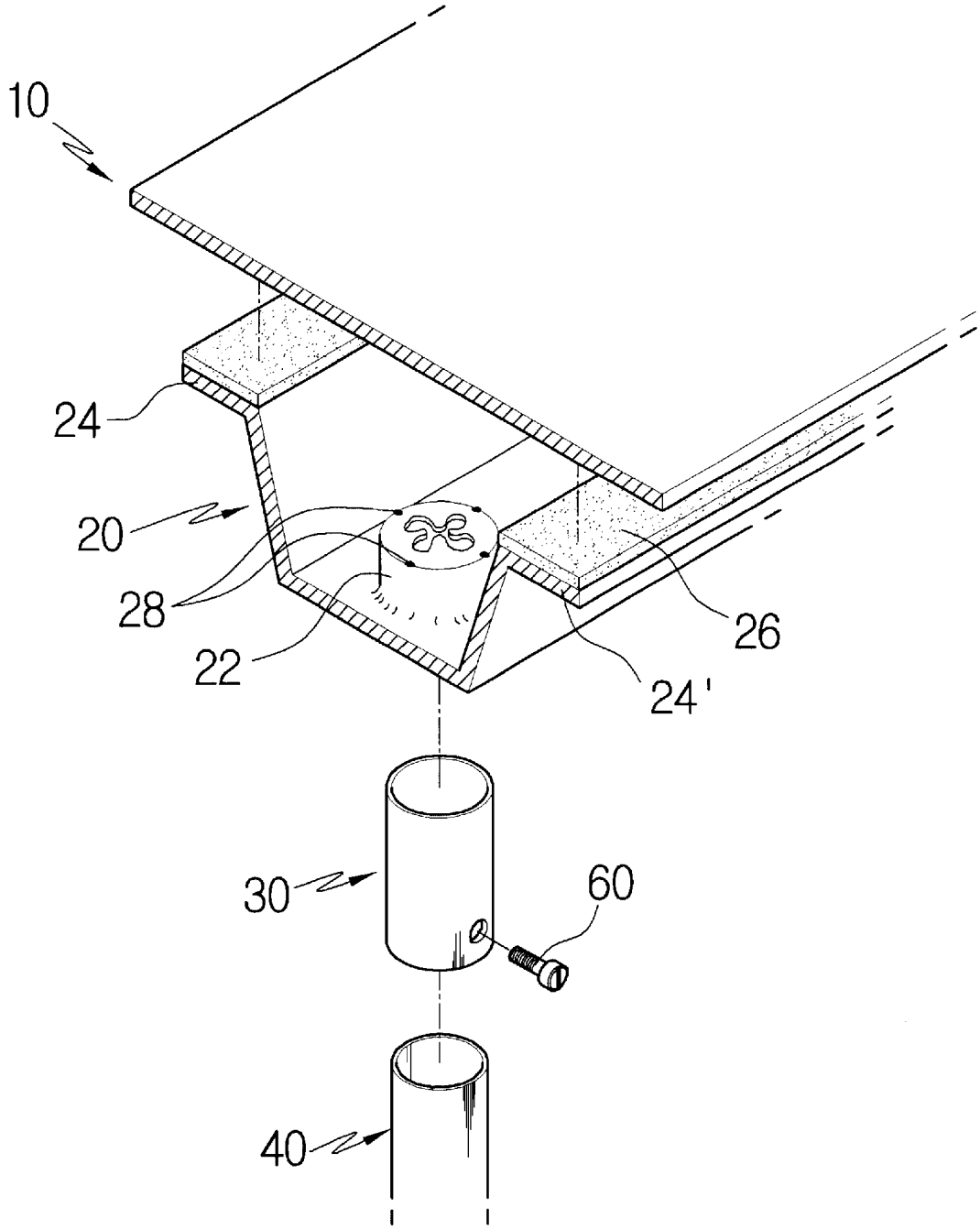
FIG. 3 is an exploded perspective view of a sectional table with gussets according to the present invention.
Figure 4:
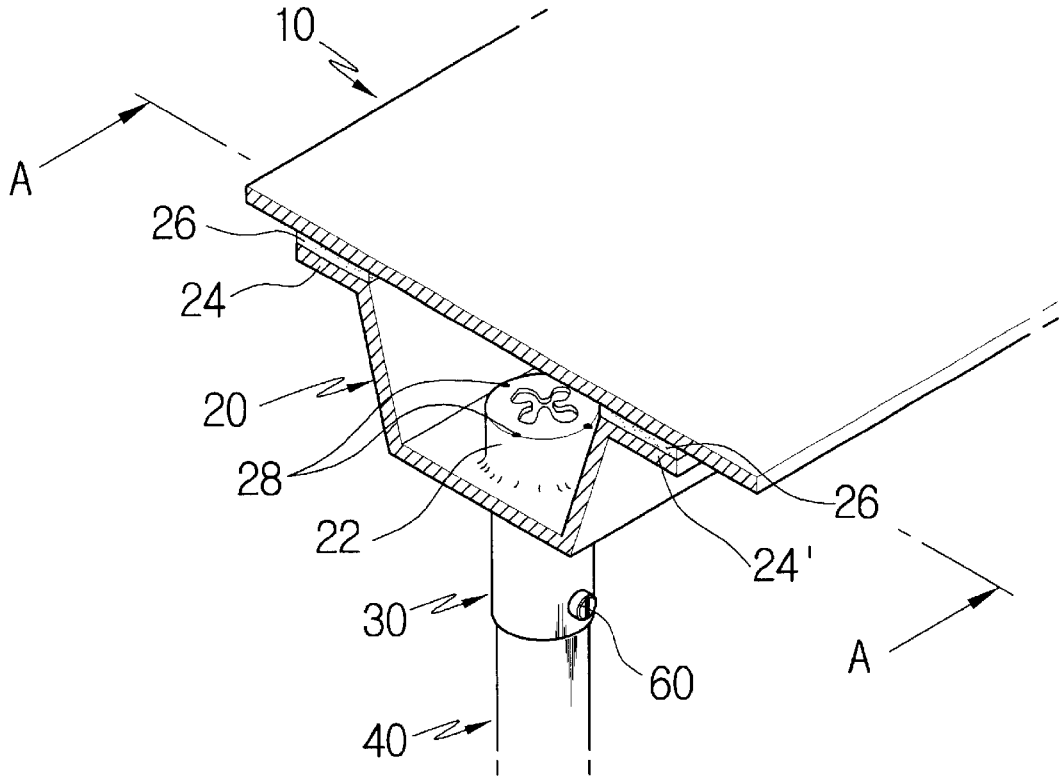
FIG. 4 is a perspective view illustrating the state in which the sectional table with gussets of FIG. 3 is assembled.
Figure 5:
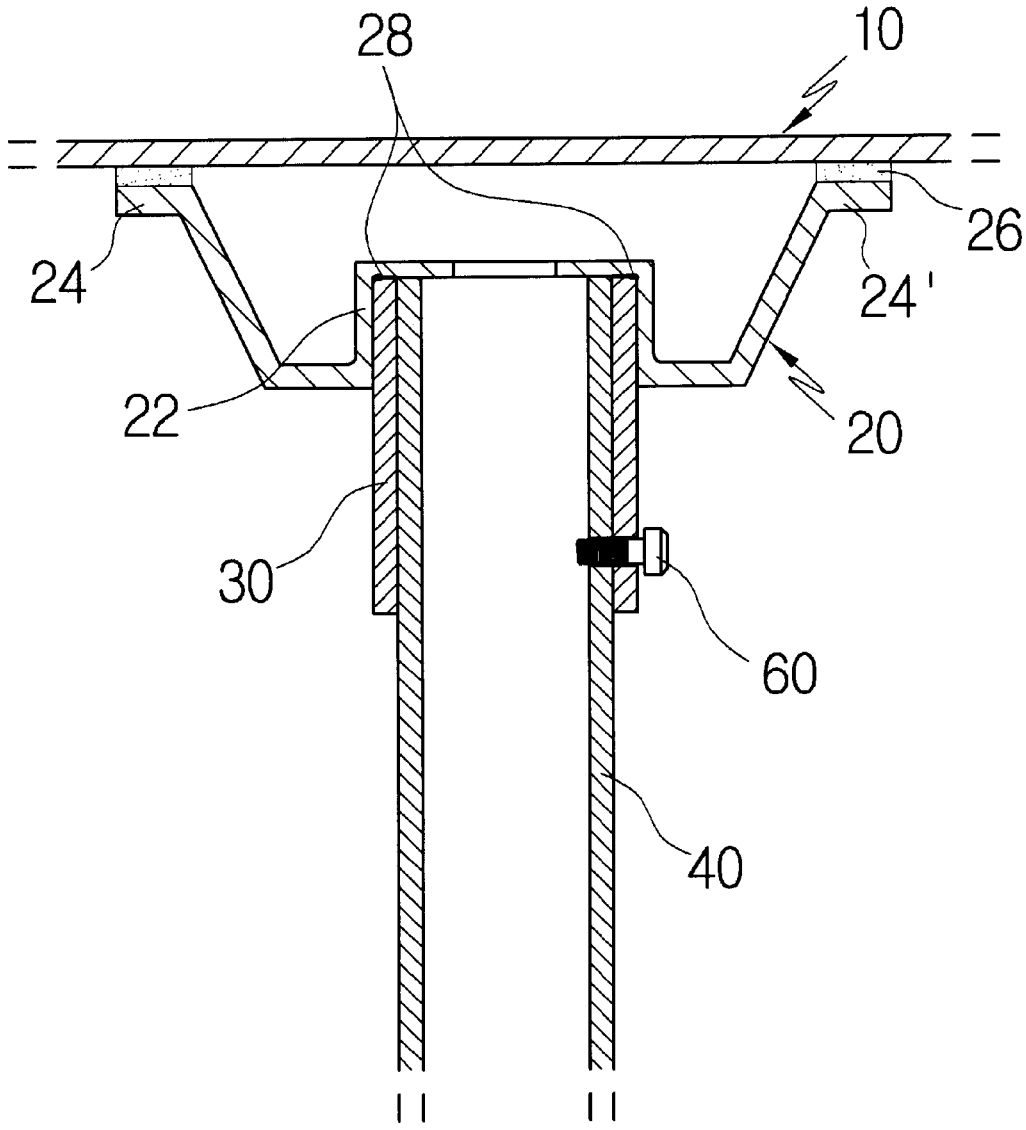
FIG. 5 is a cross sectional view taken along the line A—A of FIG. 4.

FIG. 3 is an exploded perspective view of a sectional table with gussets according to the present invention. FIG. 4 is a perspective view illustrating the state in which the sectional table with gussets of FIG. 3 is assembled. FIG. 5 is a cross sectional view taken along the line A—A of FIG. 4.

Referring to FIGS. 3 to 5, a sectional table with gussets includes a table top 10; an inverted hat-shaped channel frame 20 having cylindrical parts 22 formed at the central portion thereof and flanges 24 and 24' formed at both ends thereof, the cylindrical parts 22 being formed through a deep-drawing process and the flanges 24 and 24' being fixedly secured to the underside of the table top 10; cylindrical gussets 30 inserted into the cylindrical parts 22 of the channel frame 20 at the upper end thereof to be fixedly secured to the cylindrical parts 22 by welds; and table legs 40 secured to the underside of the table top 10 by the gussets 30 by being inserted into openings of the gussets 30.

The cylindrical parts 22 of the channel frame 20 may be modified depending on the size and shape of the gussets, and adhering members 26 are respectively provided on the upper surfaces of the flanges 24 and 24' to fixedly secure the flanges 24 and 24' to the underside of the table top 10.

Adjusting screws 60 are respectively provided on circumferential surfaces of the gussets 30 to freely adjust the height of the table legs 40 at need.

In the meantime, cross-shaped openings of the upper ends of the cylindrical parts 22 serve to prevent the cylindrical parts from being deformed when welded portions 28 are tack-welded. A welding process needs to be done only on the portion in which the gussets 30 and the cylindrical parts 22 are in contact with each other, whereby the number of work processes and manufacturing costs are reduced.

Figure 6A:
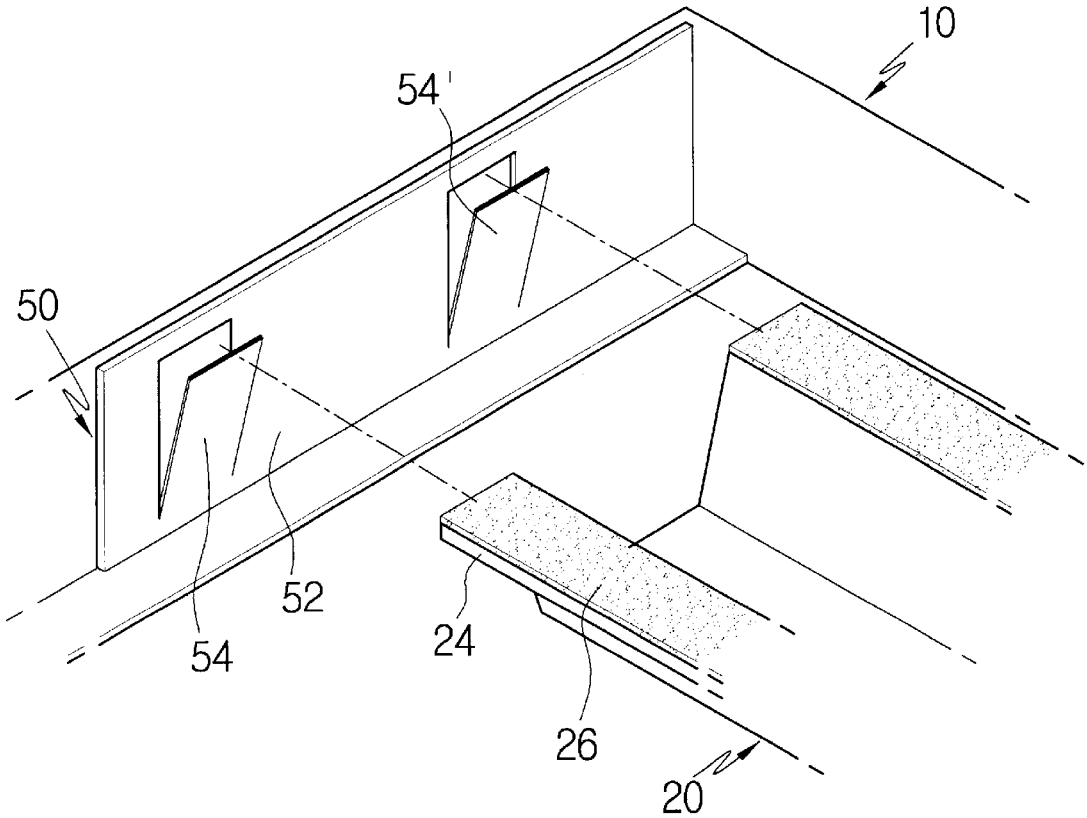
FIGS. 6(*a*) and 6(*b*) are perspective views illustrating the state in which holders and a channel frame of the sectional table with gussets are assembled according to the present invention.
Figure 6B:
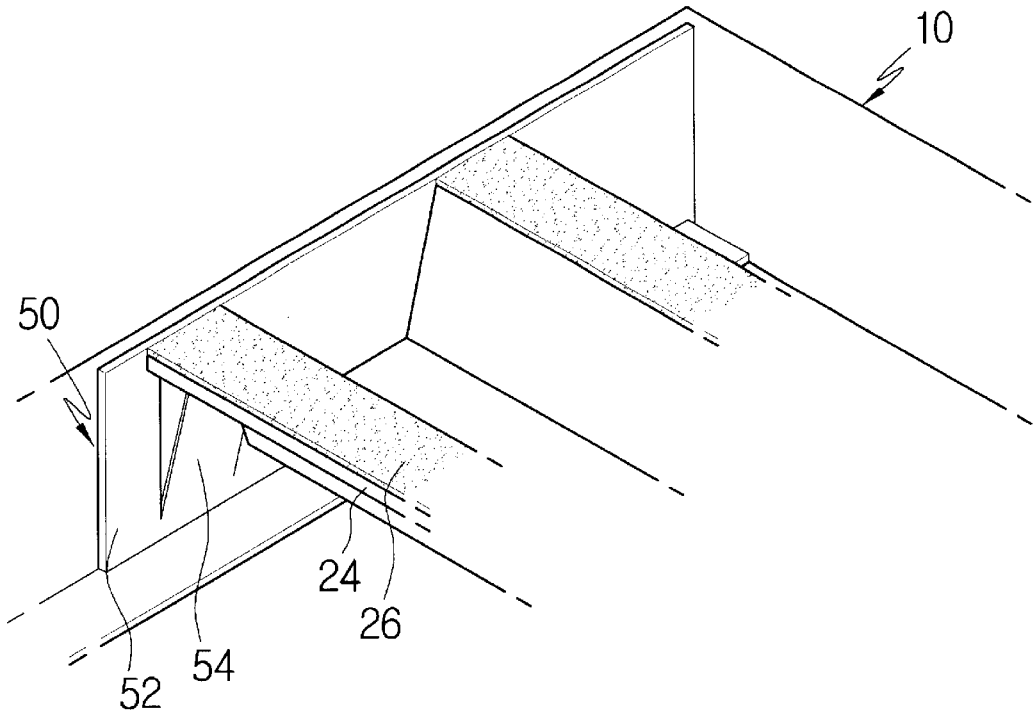

FIGS. 6(*a*) and 6(*b*) are perspective views illustrating the state in which holders and the channel frame of the sectional table with gussets are assembled according to the present invention.

As shown in FIGS. 6(*a*) and 6(*b*), each of the holders 50 includes a plate 52 fixedly mounted on the inner surface of the table top 10; and projections 54 and 54' projecting from the plate 52 and supported on the bottom surfaces of the flanges 24 and 24' of the channel frame 20 in such a manner that they are in close contact with the bottom surfaces thereof.

The holders 50 serve to easily fix the position of the channel frame 20 and also prevent the table top 10 and the channel frame 20 from being separated from each other even though the adhesive force of the adhering members 60 deteriorates. The holders 50 are mounted to be attachable and detachable in a simple fashion if necessary.

The projections 54 and 54' may be modified depending on the shape and size of the channel frame 20.

As described above, the present invention has an advantage of simplifying the assembling process, if being compared with the conventional U.S. Pat. No. 5,165,349, since the connected state between the gussets and the channel frame can be rigidly maintained without a back-up plate. The present invention has another advantage of improving workability and efficiency in assembling since the welded portions are reduced in number to one, that is, the portion where the gussets and the cylindrical parts are in contact with each other.

As a result, the present invention has a further advantage in an economic aspect since the number of work processes and manufacturing costs are accordingly reduced.

Moreover, the present invention has still another advantage of easily fixing the position of the channel frame since the holders are employed, and preventing the table top from being separated from the channel frame even though the adhesive force of the adhering members decreases.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A sectional table with gussets, comprising:

a table top having an underside;

an inverted, hat-shaped channel frame comprising at least one cylindrical part formed at a central portion thereof first and second ends, and first and second flanges disposed at the first and second ends, respectively, wherein the first and second flanges are fixedly secured to the underside of the table top;

a cylindrical gusset inserted into the cylindrical part of the channel frame, wherein an upper end of the cylindrical gusset is fixedly secured to the cylindrical part by welds;

a table leg secured to the underside of the table top by being inserted into an opening disposed on a lower end of the gusset; and at least one holder mounted on an inner side surface of the table top, the holder comprising a plate in operational contact with the channel frame.

2. The sectional table of claim 1, wherein the holder further comprises at least one projection supporting the flanges of the channel frame, wherein the projection is in operational contact with a bottom surface of the flange.

3. The sectional table of claim 2, wherein the projection comprises a prong having an upper edge that extends away from an upper end of the holder.

4. The sectional table of claim 1, wherein the cylindrical part of the channel frame is formed through a deep drawing process.

5. The sectional table of claim 1, wherein the cylindrical gusset is secured to the cylindrical part of the channel frame by welding.

6. An apparatus for connecting a leg to a table top, the apparatus comprising:

an inverted, hat-shaped channel frame comprising at least one cylindrical part formed at the central portion thereof, first and second ends, and first and second flanges disposed at the first and second ends, respectively, wherein upper surfaces of the first and second flanges are fixedly secured to an underside of the table top;

first and second upward extending prongs that are mounted on an inner side surface of the table top, wherein distal ends of the upward extending prongs are in operational contact with at least a bottom surface of the first and second flanges, respectively; and a cylindrical gusset inserted into the cylindrical part of the channel frame, wherein an upper end of the cylindrical gusset is fixedly secured to the cylindrical part and the leg is inserted into an opening disposed on a lower end of the cylindrical gusset.

* * * * *